US005297412A

United States Patent [19]

Maggi

[11] Patent Number: 5,297,412

[45] Date of Patent: Mar. 29, 1994

[54] WIRE WORKING TOOL AND HOLDER

[75] Inventor: Luigi Maggi, Lecco, Italy

[73] Assignee: North America OMCG, Inc., Bridgeport, Conn.

[21] Appl. No.: 992,378

[22] Filed: Dec. 16, 1992

Related U.S. Application Data

[62] Division of Ser. No. 518,074, May 2, 1990, Pat. No. 5,203,191.

[51] Int. Cl.[5] ..... B21F 35/02

[52] U.S. Cl. ..... 72/140; 72/481

[58] Field of Search ..... 72/140, 135, 481, 477, 72/476; 407/66, 101, 102, 104; 408/239 A, 713

[56] References Cited

U.S. PATENT DOCUMENTS

| | | | |
|---|---|---|---|
| 3,146,802 | 9/1964 | Munz . | |
| 3,242,714 | 3/1966 | Savory . | |
| 3,342,052 | 9/1967 | Boy | 72/477 |
| 3,851,518 | 12/1974 | Spengler . | |
| 4,195,538 | 4/1980 | Brown . | |
| 4,471,819 | 9/1984 | Nihashi . | |
| 4,607,517 | 8/1986 | Finzer . | |
| 4,669,359 | 6/1987 | Shiba . | |
| 4,680,955 | 7/1987 | Sakamoto . | |
| 4,696,178 | 9/1987 | Bihler . | |
| 4,708,009 | 11/1987 | Post . | |
| 4,924,693 | 5/1990 | College . | |
| 5,105,641 | 4/1992 | Veit | 72/140 |

FOREIGN PATENT DOCUMENTS

| | | |
|---|---|---|
| 2618846 | 11/1977 | Fed. Rep. of Germany . |
| 3416215A | 11/1985 | Fed. Rep. of Germany . |
| 56-82148 | 7/1981 | Japan . |

*Primary Examiner*—Lowell A. Larson
*Assistant Examiner*—Michael J. McKeon
*Attorney, Agent, or Firm*—St.Onge Steward Johnston & Reens

[57] ABSTRACT

A wire working machine and system are described with a working platform on which a rotatable mount with individually controllable wire working tool actuators is provided. The rotatable mount surrounds a workzone in which wire is worked with the tool mount being rotatable about the workzone to provide center line working of the wire. The rotatable mount is formed with removable segments each of which can support a tool actuator but can be removed to enlarge the workzone. The workzone extends through the working platform to enable a second rotatable mount located on the opposite side to form workpieces passed through the workzone. The working platform is movable in x and y directions to align with a wire preforming machine to form a wire working system with great versatility, accuracy and improved productivity.

6 Claims, 18 Drawing Sheets

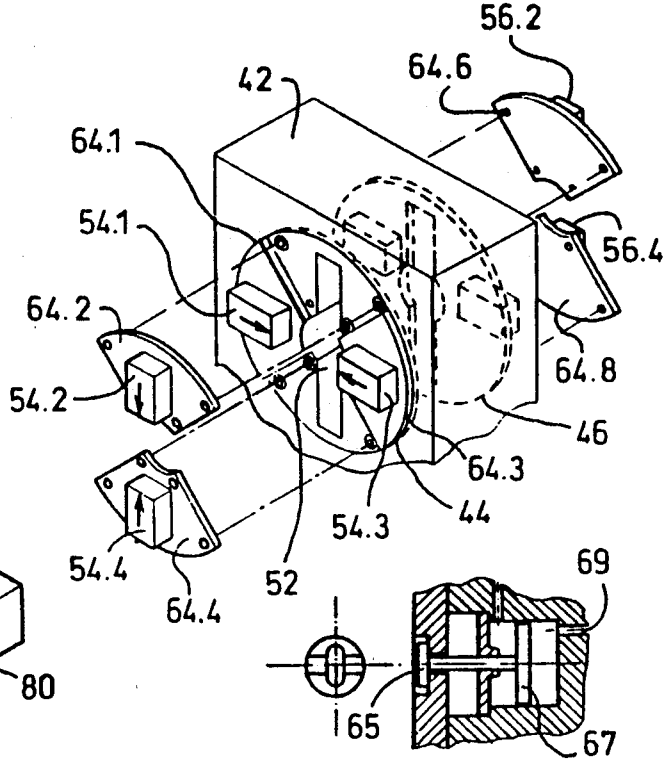
FIG. 2
FIG. 3
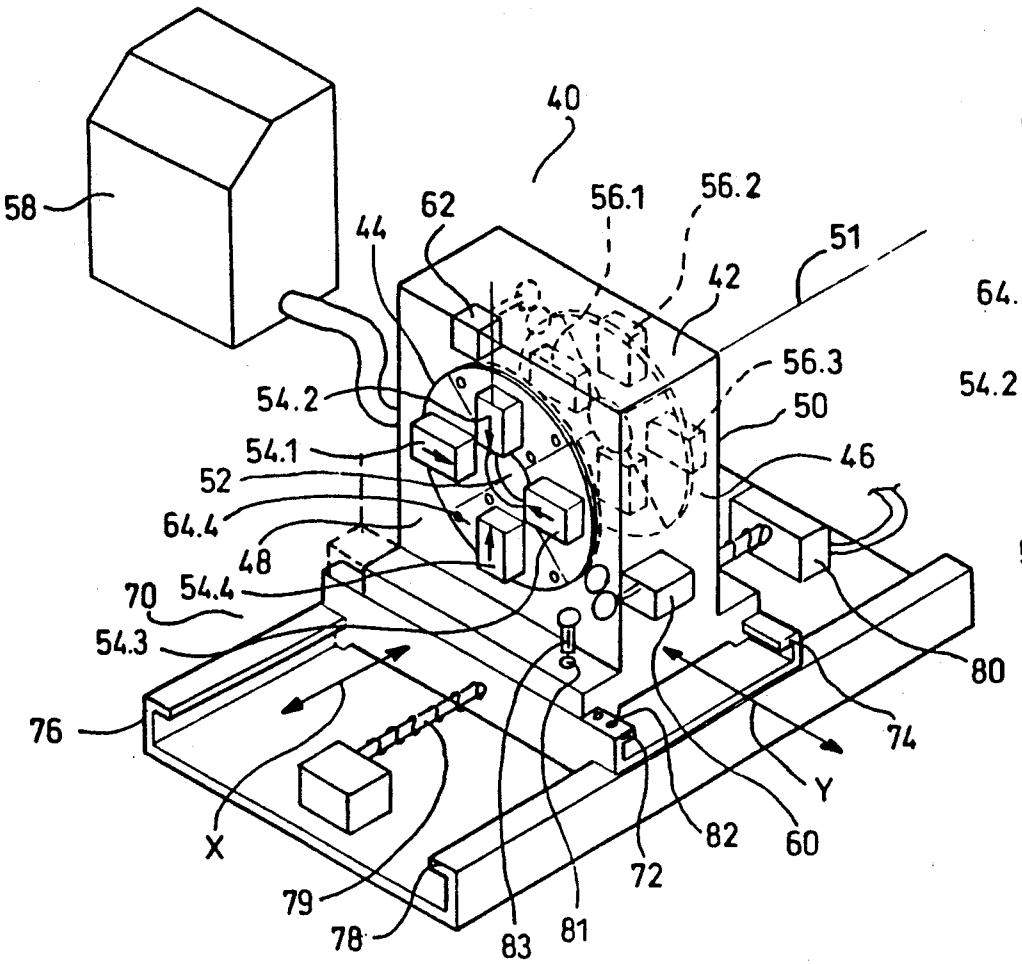
FIG. 1

108
110
5B
102
118
114
112
149
104
54
100
106
116
113
120
122
137
138
136
139
126
133
134
124
135
130
118
116
106
131
147
143
132
5
14

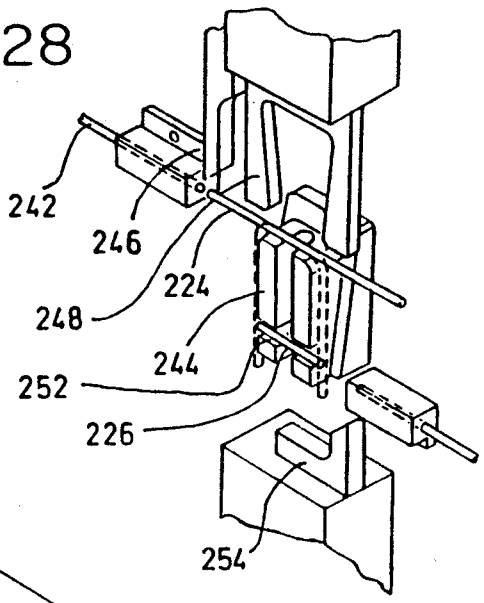
FIG. 28
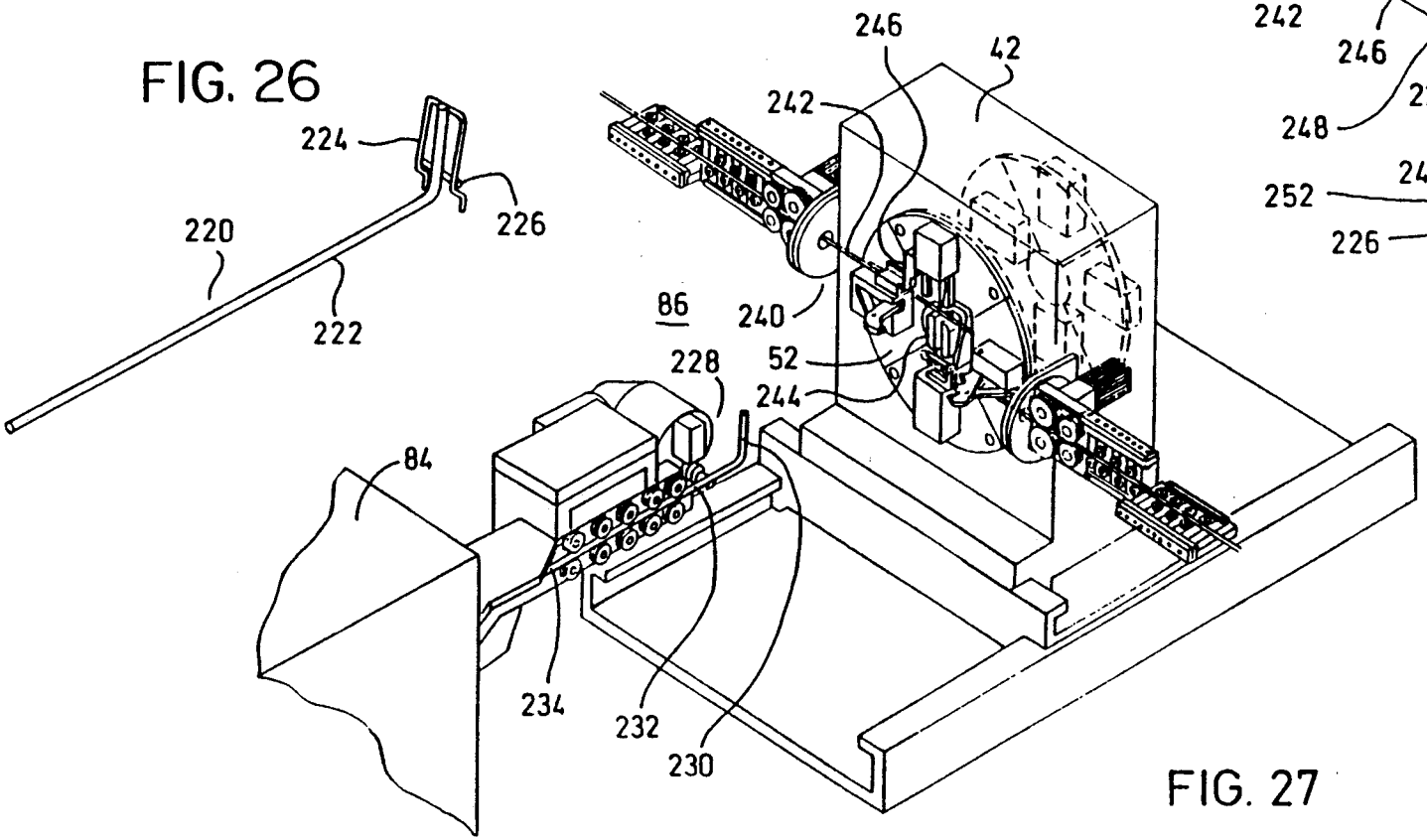
FIG. 27
FIG. 26

WIRE WORKING TOOL AND HOLDER

This is a divisional of application Ser. No. 07/518,074 filed on May 2, 1990 now U.S. Pat No. 5,203,191.

FIELD OF THE INVENTION

This invention relates to metal wire working machines.

BACKGROUND OF THE INVENTION

Automatic metal wire working machines have been used for a long time. U.S. Pat. No. 3,851,518, for example, shows a bending apparatus for wire also referred to as strip stock. The apparatus uses a rotatable worktable that can rotate in response to a deformation force applied to the strip when it is bent. The worktable can be rotated to work on the strip from different directions. The tool is located on a slide carrier to adjust the tool relative to the center of the turntable. The strip is fed parallel to the plane in which the turntable rotates.

U.S. Pat. No. 4,471,819 shows a wire bending machine in which stock wire is fed parallel to the plane of a generally flat working platform on which various wire working tools are located to bend the wire. U.S. Pat. No. 4,607,517 illustrates a plurality of wire bending tools distributed around a rotational axis of a fixed platform. Each tool is geared to a ring gear so as to work on a strip material in a predetermined timed relationship with the ring gear rotation. The individual tools are mounted for quick individual removal or installation depending on the requirement for that tool. The strip or wire stock is fed in a direction that is generally parallel to the plane of rotation of the rotating platform. Operation of each tool segment is controlled by the rotation of the ring gear.

SUMMARY OF THE INVENTION

With a wire (flat or round) working machine in accordance with the invention, a highly versatile machine is obtained capable of performing many work piece forming operations with tools that are convenient to set up.

Significant reductions in downtimes during tool changes can be achieved in comparison with current wire forming machines. Improvement in the quality control of workpieces is obtained by dispensing with manual adjustments and enabling automatic tool adjustments to compensate for tool wear and material spring back variations or for other requirements.

With a wire working machine in accordance with the invention, large size variations of workpieces can be accommodated. On-center working of workpieces can be achieved under most conditions with less side loading on tools to yield a longer tool life.

Increased production speed by simultaneous multiple workpiece working can be achieved with minimum operator training and minimum operator interferences with machine functions.

These advantages are achieved with a wire working machine in which the tools can be oriented in a precisely controllable manner so that their working forces can be applied in the most favorable directions. The tools are, therefore, mounted on a rotatable mount whose angular position relative to a central workzone is precisely controlled. The tools each are provided with individual actuators which can controllably regulate the movement of the tools along radial directions with great force for various working needs yet with high precision to provide high quality workpieces in a repeatable manner.

As described herein for one wire working machine in accordance with the invention, the rotating mount is formed of removable segments. In this manner the central workzone can be altered in size to accommodate different workpiece sizes by removing a segment. The tools and their actuators are mounted on respective segments and are, when installed, at precisely known and aligned positions.

Versatility of a wire working machine in accordance with the invention can be appreciated from a preferred embodiment in which a working platform is provided with a workzone that extends through the platform from one side to the other side. The platform has one rotatable tool mount on one side and another rotatable mount on the other side with both tool mounts being rotatable about the workzone.

With such double rotational mounts, a workpiece can be worked on both sides of the machine to achieve particular bends or assemblies as may be required. The rotatable tool mounts can be controlled to cooperate with each other with respect to a workpiece that is passed through the workzone from one side to the other.

As further described herein, the working platform conveniently cooperates with other wire working machines. For example, a conventional wire bending machine may be placed in proximity to and in cooperative relationship with a wire working machine of this invention. The wire bender may preform a workpiece which is then delivered to the workzone. Transfer of the preformed workpiece can be achieved with a conveyor or by mounting the working platform on an x-y movable base. The working platform can then be moved to a desired receiving position to enable transfer of the preformed workpiece.

It is, therefore, an object of the invention to provide a wire working method and a wire working machine and system which can be used for a broad range of wire forming and assembling operations, are convenient to set up and operate, can be used in conjunction with other wire working machines, can yield improved production capacity with less tool wear and are conveniently adjustable.

The term "wire" as used herein means a strip, or round wire or such other elongate metal workpiece as can be formed by machines of the type described herein.

These and other objects and advantages of a wire working machine in accordance with the invention can be understood from the following detailed description of a preferred embodiment as shown in the accompanying drawings.

BRIEF DESCRIPTION OF THE DRAWINGS

FIG. 1 is a perspective view of a wire working machine in accordance with the invention;

FIG. 2 is an enlarged exploded perspective view of a segmentable rotatable tool mount used on the wire working machine as shown in FIG. 1;

FIG. 3 is an enlarged sectional view of a quick connection used to mount segments of a tool mount;

FIG. 26 is a perspective view of a workpiece made in accordance with the invention;

FIG. 27 is a perspective view of a system in accordance with the invention to manufacture the workpiece of FIG. 26;

FIG. 28 is an enlarged perspective view of a portion of the system of FIG. 27;

DETAILED DESCRIPTION OF DRAWINGS

Figure 4:
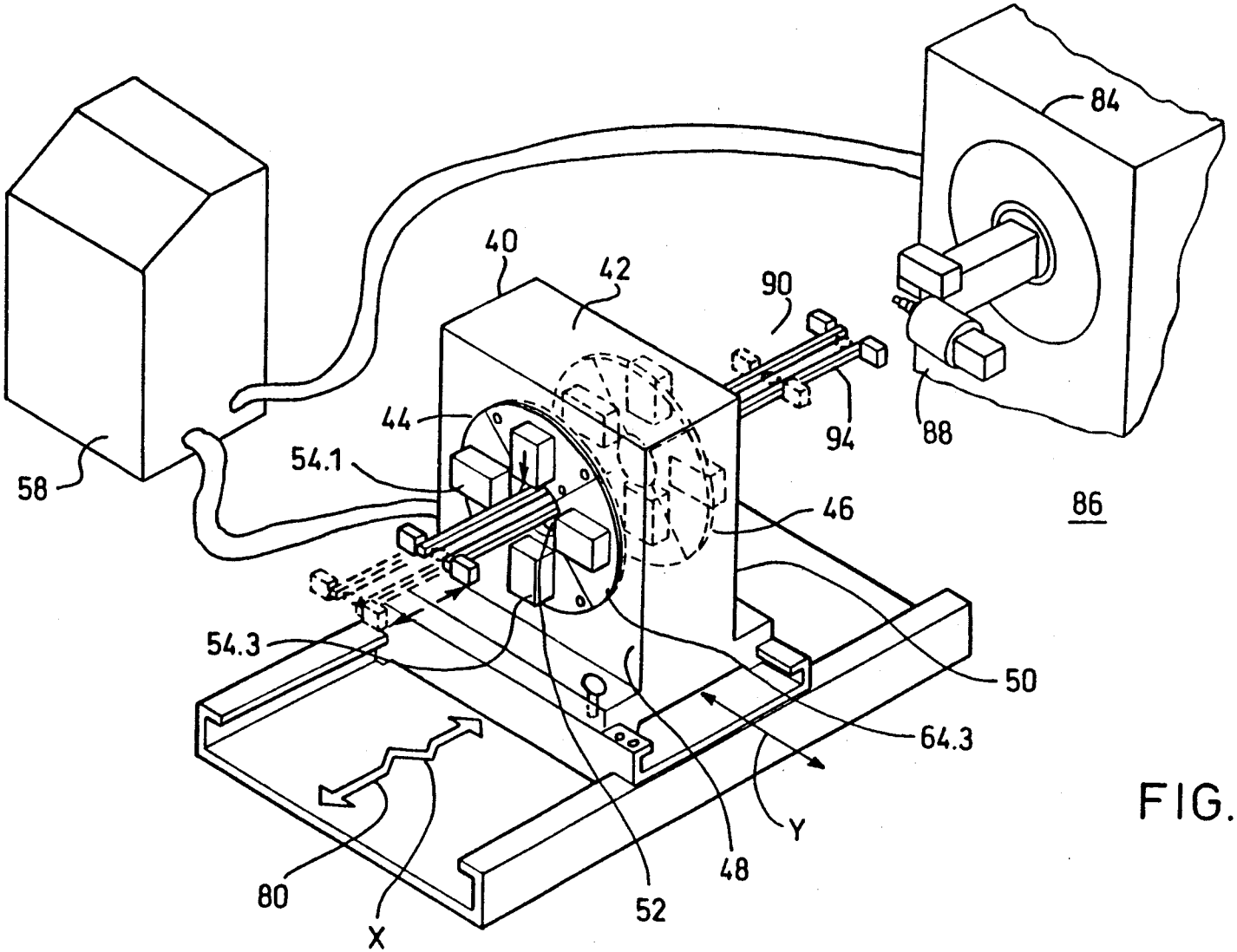
FIG. 4 is a partial perspective view of a wire working machine in conjunction with a conventional wire bender.

With reference to FIGS. 1-3, a wire working machine 40 in accordance with the invention is shown. The wire working machine 40 includes an x and y direction movable working platform 42 having rotatable tool mounts 44, 46 on opposite sides 48, 50 of the platform 42. Platform 42 is shown in the form of a housing that encloses other support equipment. Platform 42, however, can be a frame or a plate or of other suitable construction.

The rotatable tool mounts, 44, 46 have a central workzone 52 that extends through platform 42 from side 48 to side 50. The workzone thus enables one to work on a workpiece on one side such as 48 or 50 and subsequently pass it through the workzone to the other side for working.

Each tool mount 44, 46 is provided with a plurality of removable tool actuators 54.1-54.4 on side 48 and actuators 56.1-56.4 on side 50. Actuators 54 and 56 are individually driven under control from a computer 58 and their motion can be precisely regulated and executed with great force. The actuators 54 and 56 are mounted so as to move their respective tools along radial lines emanating from axis 51.

The tool mounts 44, 46 are each rotatable about a common axis 51 that is generally centrally located in workzone 52. Rotation can be done by hand to selected angular positions but preferably is obtained with individually computer controlled motors 60, 62 operatively coupled to a ring gear attached to mounts 44, 46. Motors 60, 62 can be coupled to mounts 44, 46 with belts or pinions. Motors 60, 62 are sufficient in size to rapidly move a tool actuator to a desired angular position.

Each tool mount 44, 46 is formed with removable segments 64. Each segment supports a tool actuator 54 or 56. The segments 64 are individually removable as illustrated in FIG. 2 to enlarge the crossectional area of the workzone 52 as this may be needed to, for example, accommodate a workpiece that is larger than the workzone 52 when all segments 64 are in place.

The attachment and removal of segments 64 can be quickly done with conventional quick release and locking elements 65 that are hydraulically actuated as shown in FIG. 3 by a piston 67. Hydraulic fluid for movement of piston 67 is supplied through ports 69 and 71.

Each segment 64 supports a tool actuator 54 or 56 and four orthogonally oriented actuators are on a side. Different number of actuators and segments can be used on a side.

Platform 42 is mounted on a movable base 70 with which platform 42 can be controllably moved in x and y directions. Platform 42 is shown mounted on y-direction oriented rails 72, 74 which in turn are mounted for movement on x-direction oriented rails 76, 78. The x-direction motion is obtained with a lead screw 79 driven by a motor 80 that is precisely regulated from and by computer 58. The y-direction motion is obtained by moving platform 42 to successive positions where hole 81 in the base of platform 48 aligns with one of a series of holes 82 in rail 72 to receive a locking pin 83. In this manner a wire can be properly placed within the workzone 52.

A particular advantage of the wire working machine 40 is its ability to enhance and cooperate with other wire forming machines such as the wire bender 84 shown in FIG. 4. In this embodiment, a system 86 in accordance with the invention is formed by the wire bender 84 and wire working machine 40.

Working platform 42 is aligned with wire bender 84 in such manner as enables workpieces that are preformed by bender 84 to be transferred into the work zone 52. Preferably, the rotational axes of rotatable tool mounts 44, 46 are coincident with the central axis of the wire fed to the bender mechanism 88. The alignment further involves the selection of the distance between the wire working machine. This is obtained by adjusting platform 42 along its x-axis until the distance between a reference point, for example, the surface of the tool mount 46 is of a particular value relative to a reference point on wire bender 88. When alignment is completed the computer 58 can, under control by its program, move workpieces between wire bender 84 and wire working machine 40 in a precise manner.

A workpiece transferring mechanism 90 is provided. This can be in the form of a conveyor 94 that can be moved to transfer preformed workpieces from the wire bender to the workzone 52. Conveyor 94 is shown extending through the workzone 52 to also transfer workpieces between the sides 48 and 50 of platform 42.

With a system such as 86, the advantages of various particular different wire working machines can be used while enabling a rapid set-up of the required tools and obtaining a high production rate for complex work pieces. Part of these advantages are achieved with tool actuators 54, 56 that are convenient to install and can be individually controlled in a precise manner by a program in computer 58.

FIGS. 5A–5F illustrate a tool actuator module 54 or 56 that is used to work on a wire workpiece. The actuator includes a high torque motor 100, such as a servo motor, mounted on an upright segment 102 of a bracket 104. The motor output shaft is coupled to rotate a drive screw 106 with gears 108, 110, all being rotationally mounted to bracket 104. Bracket 104 has a base 112 that is removably affixed to a rotatable tool mount segment 64, see FIG. 2.

A slide 114 is mounted to move along an axis 113 with respect to base 112 and has a bottom portion 116 that, as shown in the embodiment, fits in dovetail fashion with base 112. Interengagement between slide 114 and bottom portion 116 can be obtained with different means such as a slide bearing. A plurality of roller bearing followers 118 that are affixed to slide 114 are mounted to engage the threads of drive screw 106 so that the latter's rotation causes an advance or retraction of slide 114 as suggested by double-headed arrow 120. The motor 100 and its output shaft are aligned parallel to the movement axis 113 for slide 116.

A forming tool 122 is premounted to a universal spindle-type tool holder 124. Replacement of a tool holder 122 is conveniently achieved with a robotic arm 126 and a tool holder release 130.

Operation of the tool actuator module is as follows: The motor 100 is programmable to carry the slide 114 and therefore the tool 122 to any position, within the limits of the screw 106 and at any velocity, within the limits of the motor 100. In forming a part which contains multiple features, multiple modules must be used. Positions and velocities are chosen for each module so as to synchronize their motions in a manner in which a part is formed within the shortest possible time. Good quality parts is the result of the module's ability to position the tool 122 accurately. This is achieved by the use of helical gears 108, 110 as they produce smooth motion with almost zero backlash. The screw 106 and three followers 118 are used for zero backlash. Two followers are primarily relied upon to advance the slide 114 and one is primarily relied upon to retract it.

A universal tool mount 131 is used with an alignment tool mount 132 for a forming tool 122. The back end of mount 131 is shaped to fit within a complementary-shaped spindle portion 133 that includes spring loaded gripping fingers 134. The spring loading is released by moving the slide 114 backwards until a release shaft 135 engages the tool holder release 130 which is in the form of an adjustable stop. Release movement of slide 116 can be under control by computer 58.

The advance and retraction of slide 116 requires precise referencing of the working end of forming tool 122 while being capable of repetitively transmitting large forces needed to form wires with little or no deformation of the tool former 122 while maintaining its referenced position.

Figures 5A, 5B, 5C, 5D:
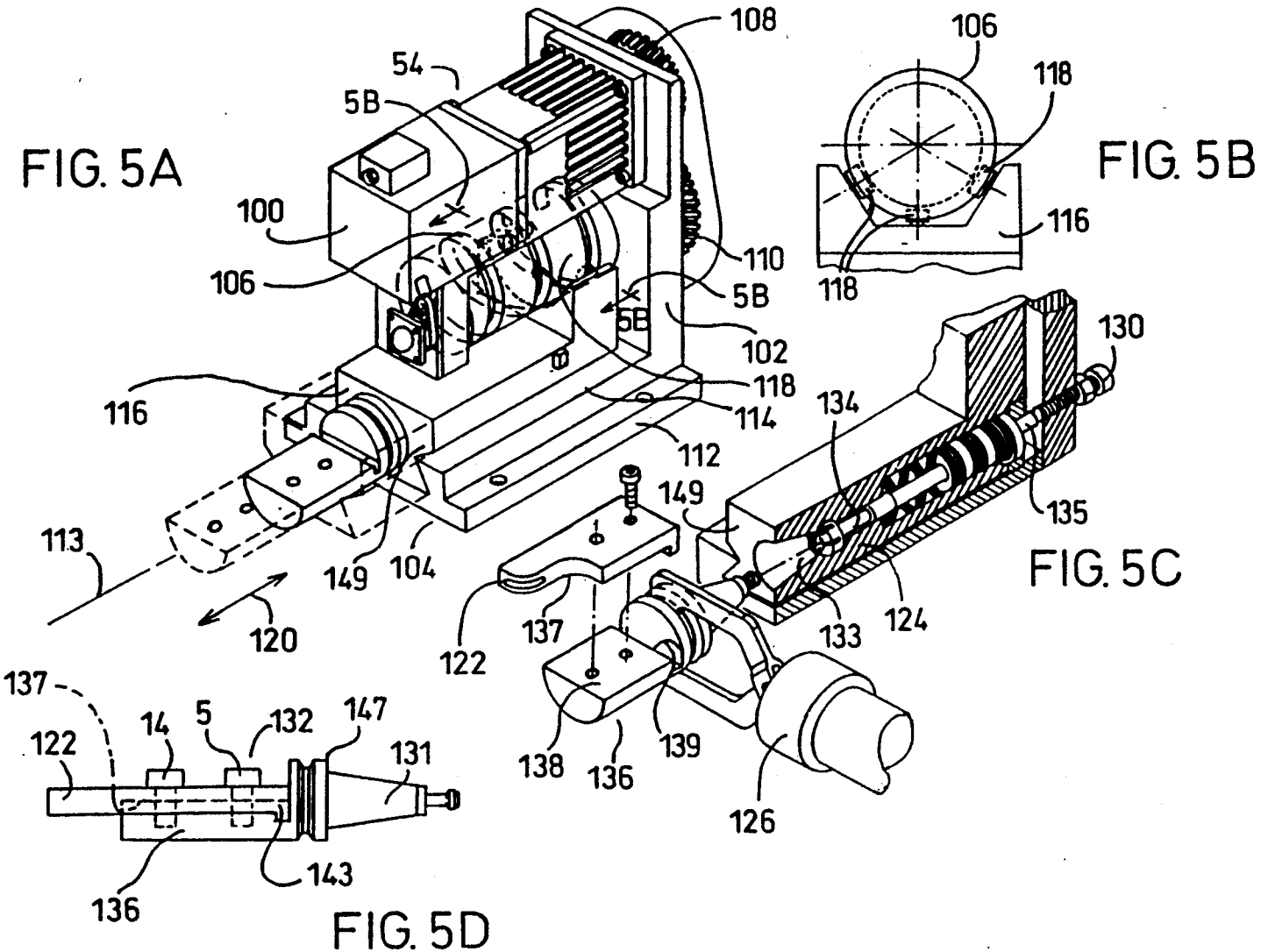
FIG. 5A is a perspective view of a tool actuator module used in a wire forming machine of FIG. 1.
FIG. 5B is a section view taken along the lines 5B—5B of the tool actuator module of FIG. 5A.
FIG. 5C is a perspective partially broken away view of a tool holder used in the tool actuator module of FIG. 5A.
FIG. 5D is a reduced side view of the tool holder shown in FIG. 5C.
Figure 5E:
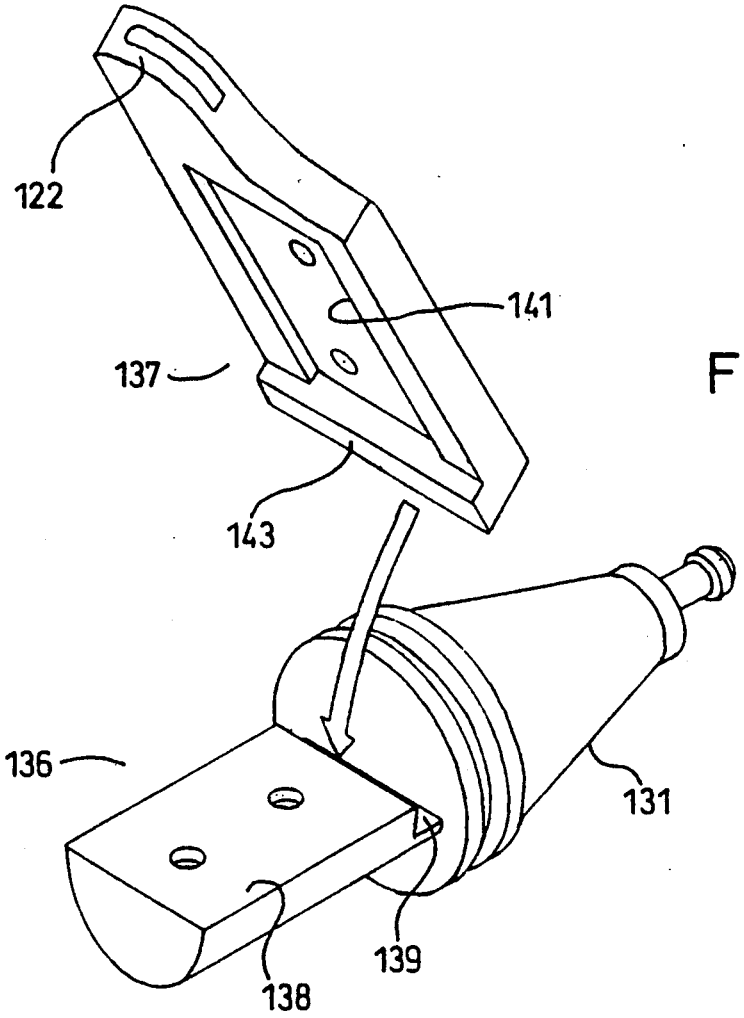
FIG. 5E is a perspective exploded view of the tool holder shown in FIG. 5D.
Figure 5F:
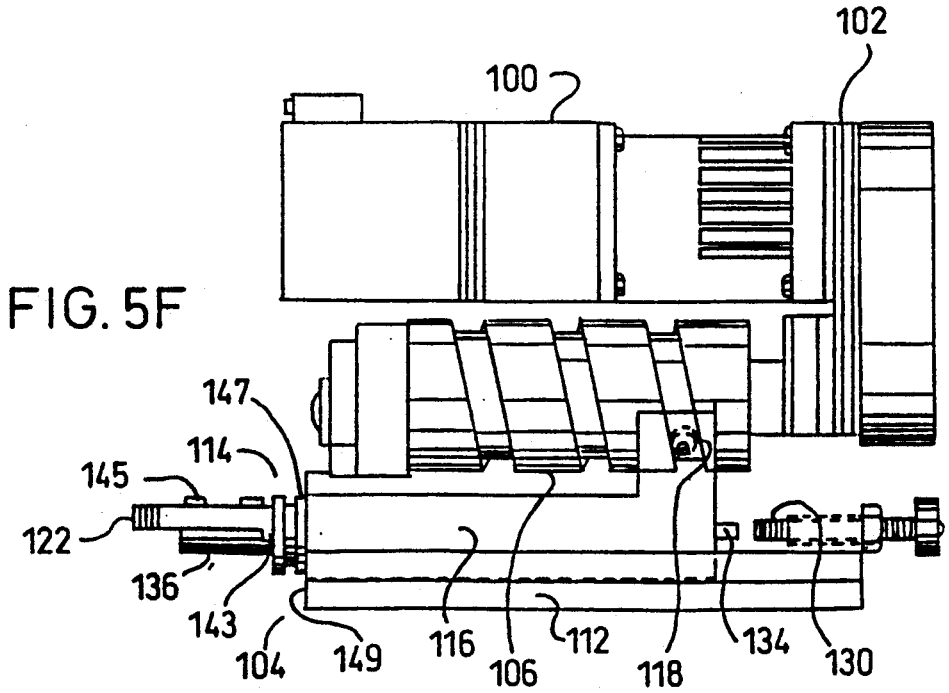
FIG. 5F is a side view in elevation of the tool actuator shown in FIG. 5A.
Figures 6, 7:
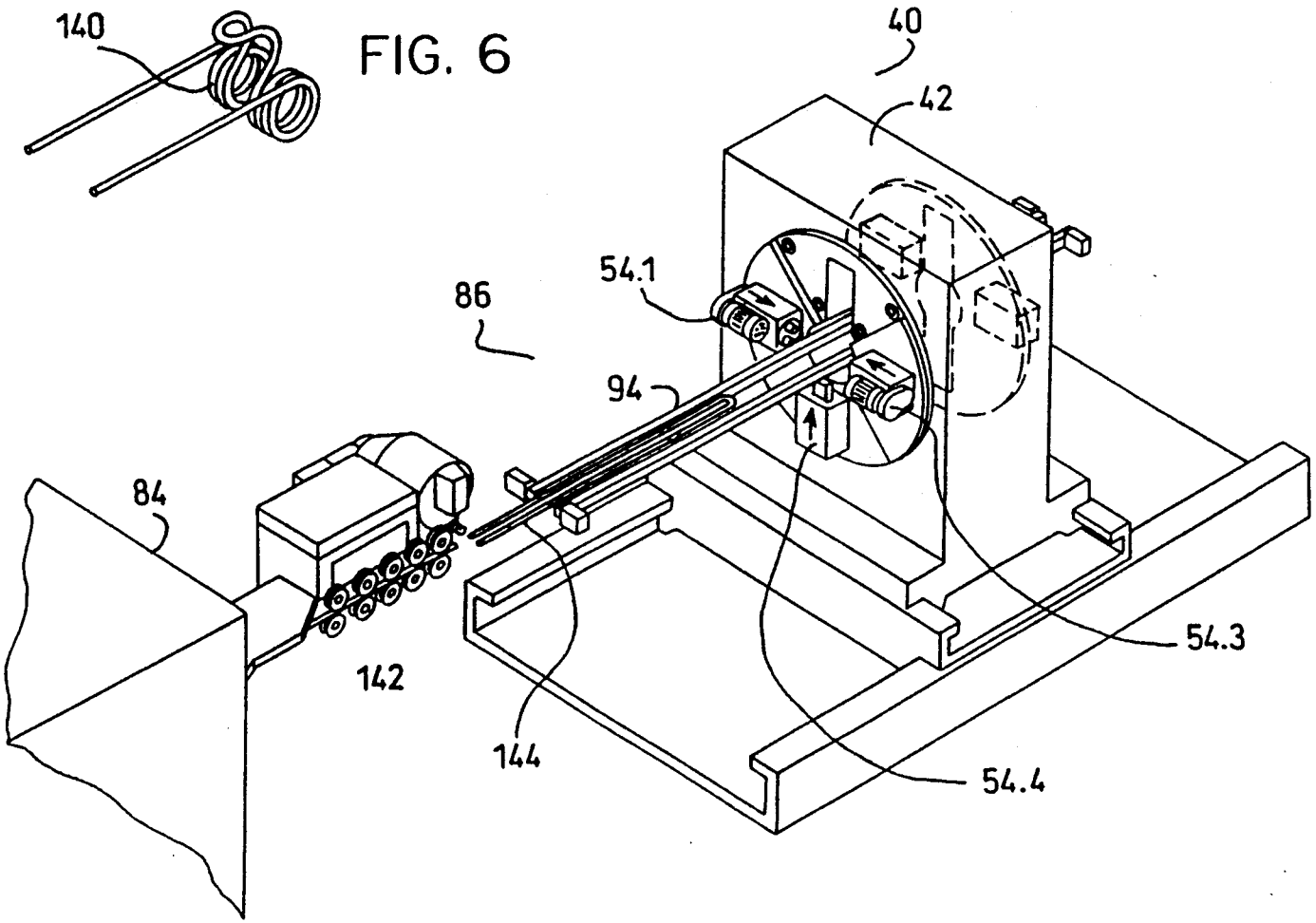
FIG. 6 is a perspective view of a workpiece to be made using a preforming machine in cooperation with a wire working machine of this invention.
FIG. 7 is a partial perspective view of a workpiece forming system in accordance with the invention in one stage of its operation towards formation of the workpiece shown in FIG. 6.
Figure 9:
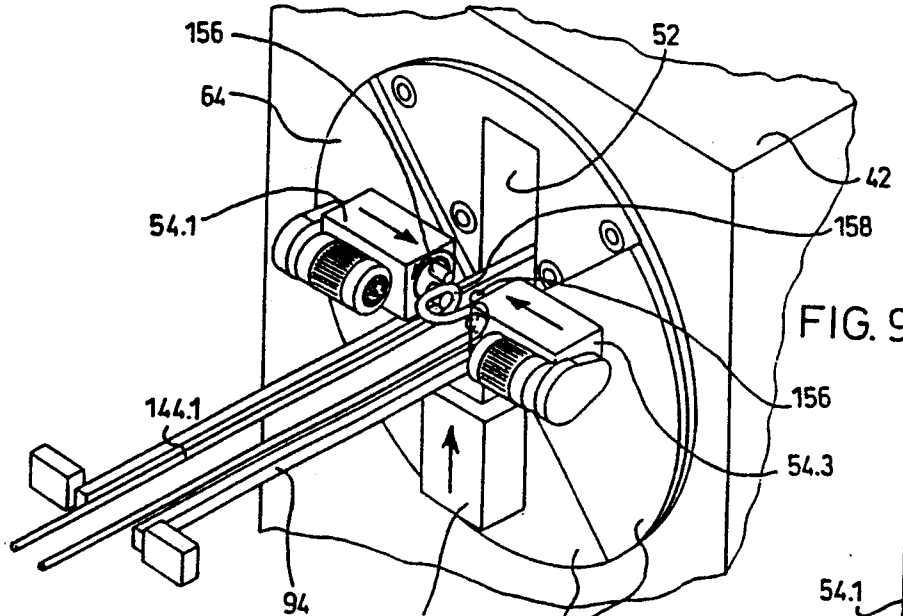
FIG. 9 is a partial perspective and enlarged view of the portion of one active rotatable tool mount of FIG. 8.

In the embodiment of FIGS. 5C–5D, a tool mount 132 having these advantages is shown in accordance with the invention. Tool mount 132 is formed of two interfitting and interlocking parts 136, 137 which are respectively part of the tool mount 131 and tool former 122. Part 136 is an integral extension of tool mount 131 and includes a flat rectangular mounting surface 138 and an accurately finished reference slot 139. Part 137 has a recess 141 sized to snugly receive surface 138 and has a reference lip 143 that snugly fits within reference slot 139. A pair of removable bolts 145 holds parts 136, 137 together. The tool mount 131 has a flange 147 that seats on the flat surface 149 of slide 116 when installed, see FIGS. 5A and 5F.

With a tool mount 132, precise location of tool former 122 can be preserved by way of the snug interfitting and interlocked relationship of parts 136 and 137. High axial and lateral forces can be accommodated while preserving the referenced position of the forming tool 122.

Note that the interfitting and interlocking relationship of the first and second parts 136, 137 can be reversed whereby part 137 has the reference slot 139 and part 136 the recess 141 and reference lip 143.

Work product consistency is achieved through the computer 58. It has the ability to shutdown the system if any of the modules are not at the programmed position within the programmed period.

FIGS. 6–11 illustrate the use of system 86 for making workpiece 140. The wire bender 84 and platform 42 are automatically operated under the control of computer 58 (not shown).

At 142 a wire preform 144 is made by wirebender 84 which bent a single wire into the illustrated preform 144. The transfer mechanism 94 is then used to advance the preform to workzone 52. At the workzone 52 the tool actuator 54.2 and its associated tool mount segment 64 have been removed to enlarge the workzone.

Figure 8:
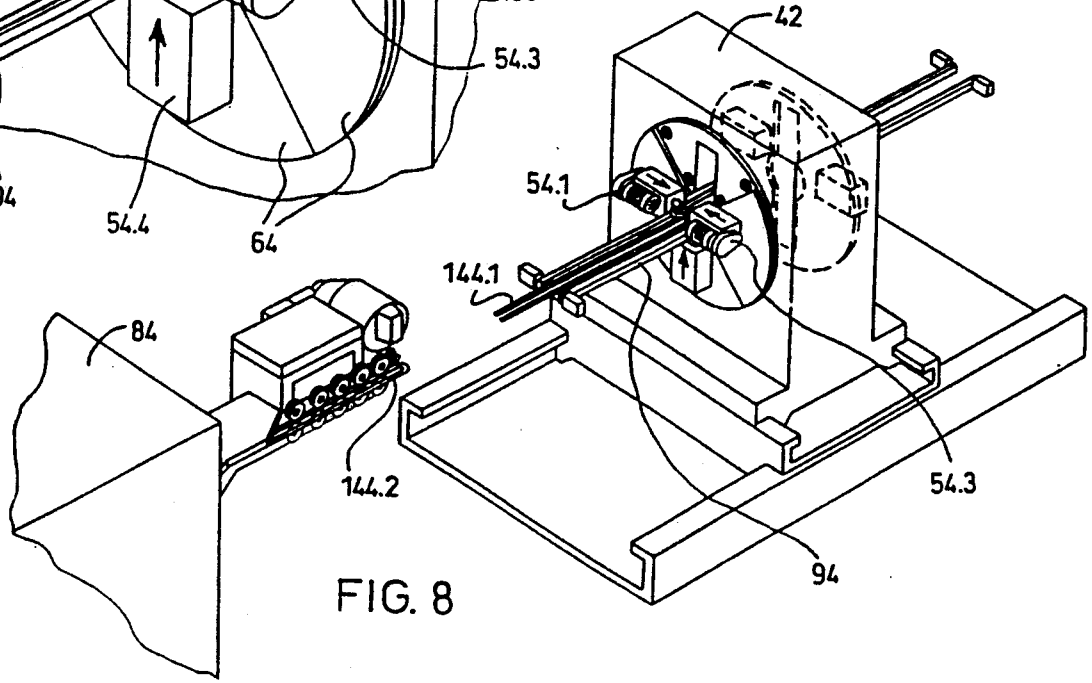
FIG. 8 is a partial perspective view of the system of FIG. 7 illustrating the next stage of manufacture for the making of the workpiece of FIG. 6.

In FIG. 8 the new preform 144.2 is being made by wire bender 84 while preform 144.1 is worked on by tools 150, 152 in tool actuators 54.1 and 54.2. The latter cause prongs 156 to be positioned so as to first engage sides of wire preform 144.1 followed by a predetermined degree of rotation to form the bend 158, see also FIG. 6.

Figure 10:
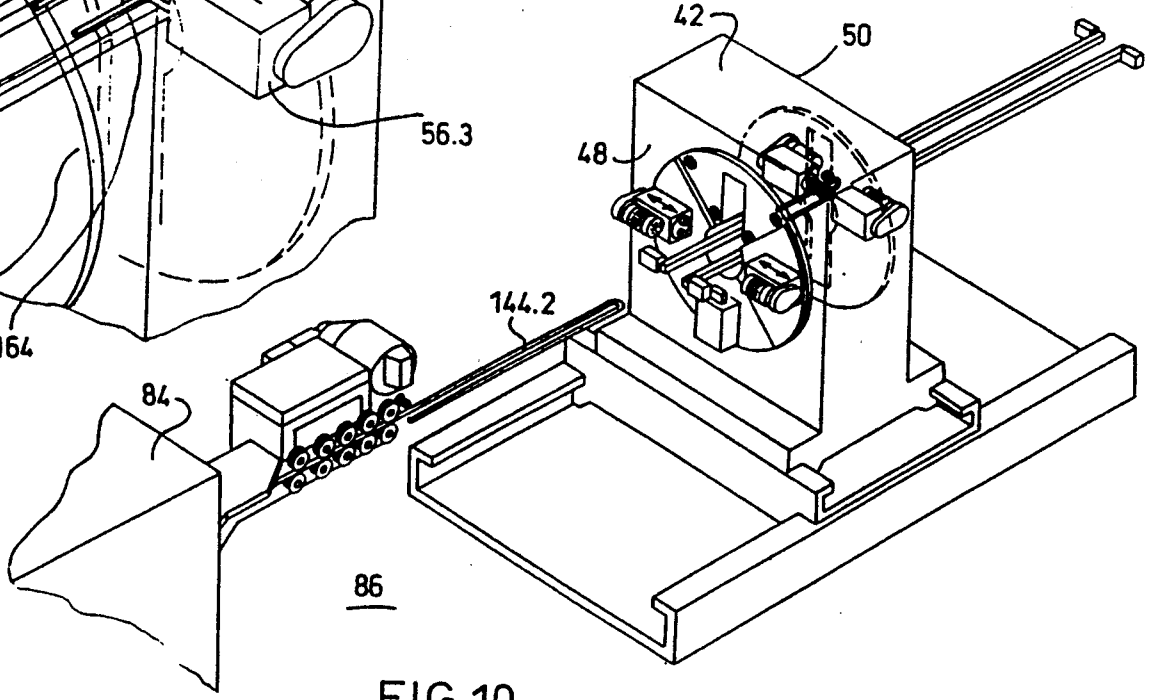
FIG. 10 is a partial perspective view of the wire working system of FIG. 7 illustrating another stage in the manufacture of the workpiece of FIG. 6.
Figure 11:
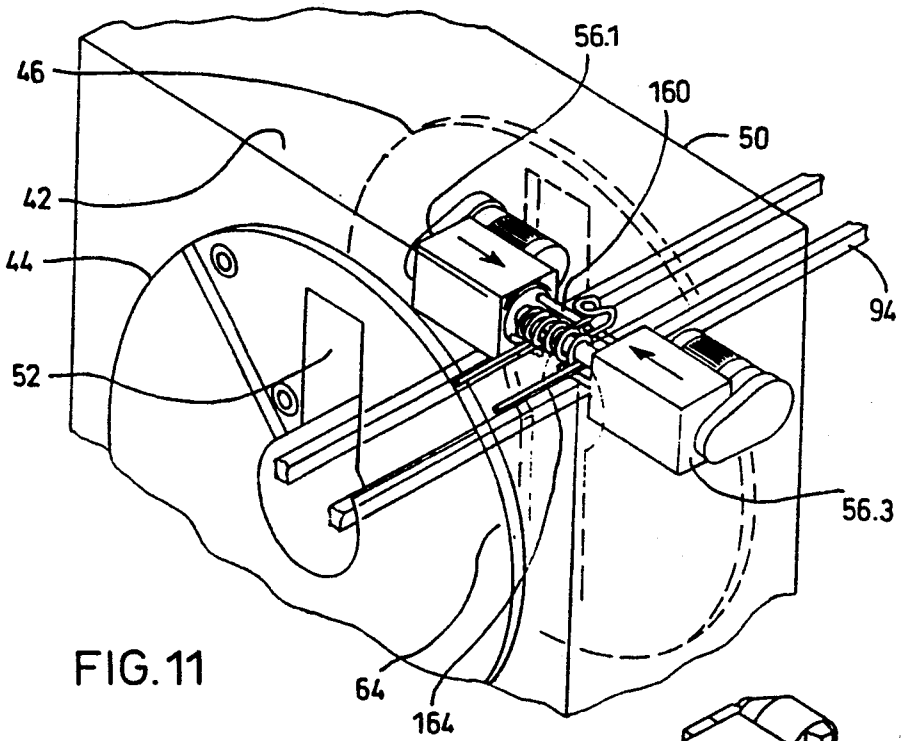
FIG. 11 is an enlarged perspective view of the portion of another active rotatable tool mount.

As shown in FIGS. 10 and 11 upon completion of bend 158, preform 144.1 is moved through the workzone 52 to side 50 of platform 42 to enable tools 160 on tool actuators 56.1 and 56.3 to form the springs 162, 164.

Figures 33, 34, 35:
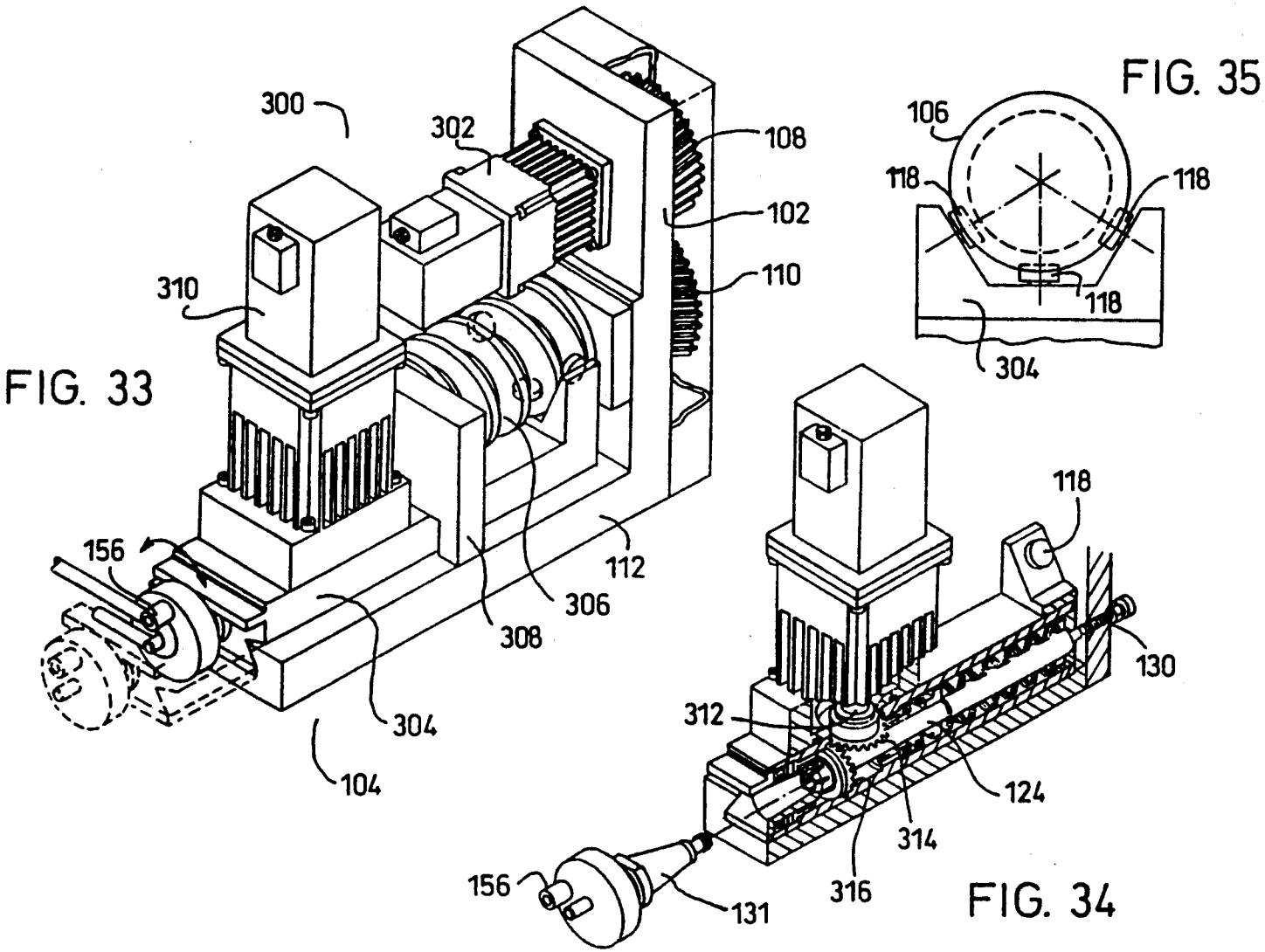
FIG. 33 is a perspective of the tool actuator for use as a wire winder.
FIG. 34 is a perspective partially broken away view of the wire winder of FIG. 33.
FIG. 35 is a section view of the lead screw used in the wire winder of FIG. 33.

FIGS. 33–35 illustrate a wire winder 300 that is particularly adapted to provide the wire coiling operations as shown and described in reference to FIGS. 8–11. The wire winder 300 can be removably mounted to a tool mount 46 and incorporates a construction that is similar to that as shown in FIGS. 5A–5F. Hence, an advance and retraction control motor 302 is mounted on the upper segment 102 of a bracket 104 whose base 112 supports a slide 304. An advance and retraction screw 306 is rotated by the motor 302 via gears 108, 110. The screw 306 is rotatably mounted between brackets 102 and 308.

A spindle rotation motor 310 is mounted onto slide 304 through which its motor shaft 312 extends. A first bevel gear 314 is mounted to shaft 312 and a second bevel gear 316 is mounted to spindle tool holder 124 and meshes with the first gear 314. Thus, rotation of the first gear 314 causes rotation of the wire winding tool 156 to thus perform the operations described with reference to FIGS. 7–11.

Insertion and release of tool 156 is obtained by moving the spindle shaft first axially against stop 130 to cause a release of the locking fingers 134. Wire winder 300, like the tool actuators 54, is removable and separately usable on wire forming machines.

Figures 12, 13:
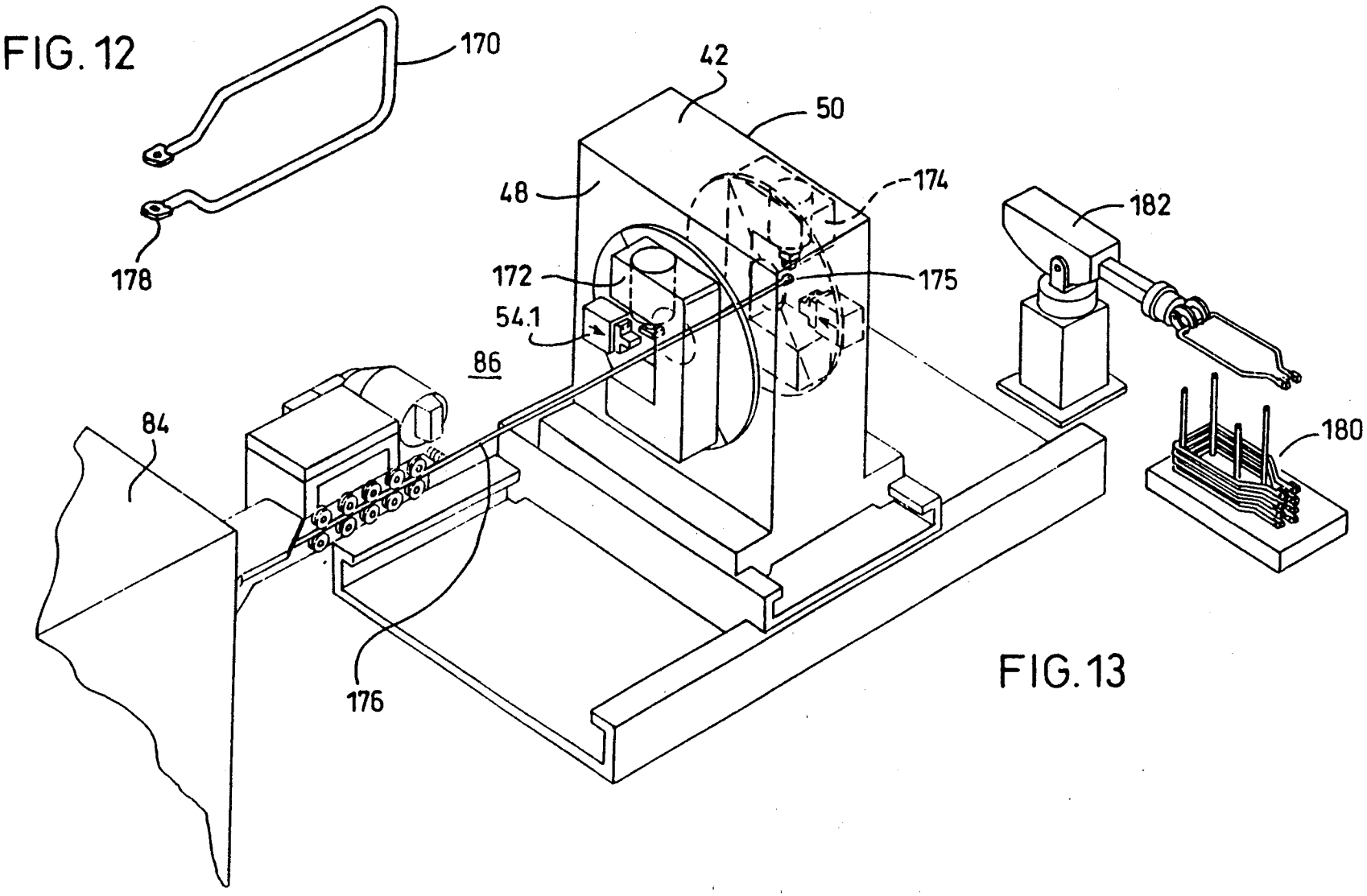
FIG. 12 is a perspective view of a workpiece.
FIG. 13 is a partial perspective view of a system of a plurality of tools and machines used to make the workpiece of FIG. 12 using a feed-through workzone in accordance with the invention.

FIGS. 12–18 illustrate other advantages and features of a wire working method and system in accordance with the invention when making a workpiece such as 170 shown in FIG. 12. Some of the previously illustrated tools and tool actuators on sides 48 and 52 of working platform 42 have been replaced by a flattener 172 on side 48 of platform 42 and a cutter and hole puncher 174 on side 50 of wire working platform 42.

At 175 in FIG. 13, wire stock 176 from wire bender 84 has just undergone the last step in the previous cycle for making workpiece 170. At this stage the end 178 of wire stock 176 has been flattened and hole-punched as shown with greater detail in FIG. 12. The previously completed workpiece is shown being placed on a stack 180 by a manipulator 182.

Figure 14:
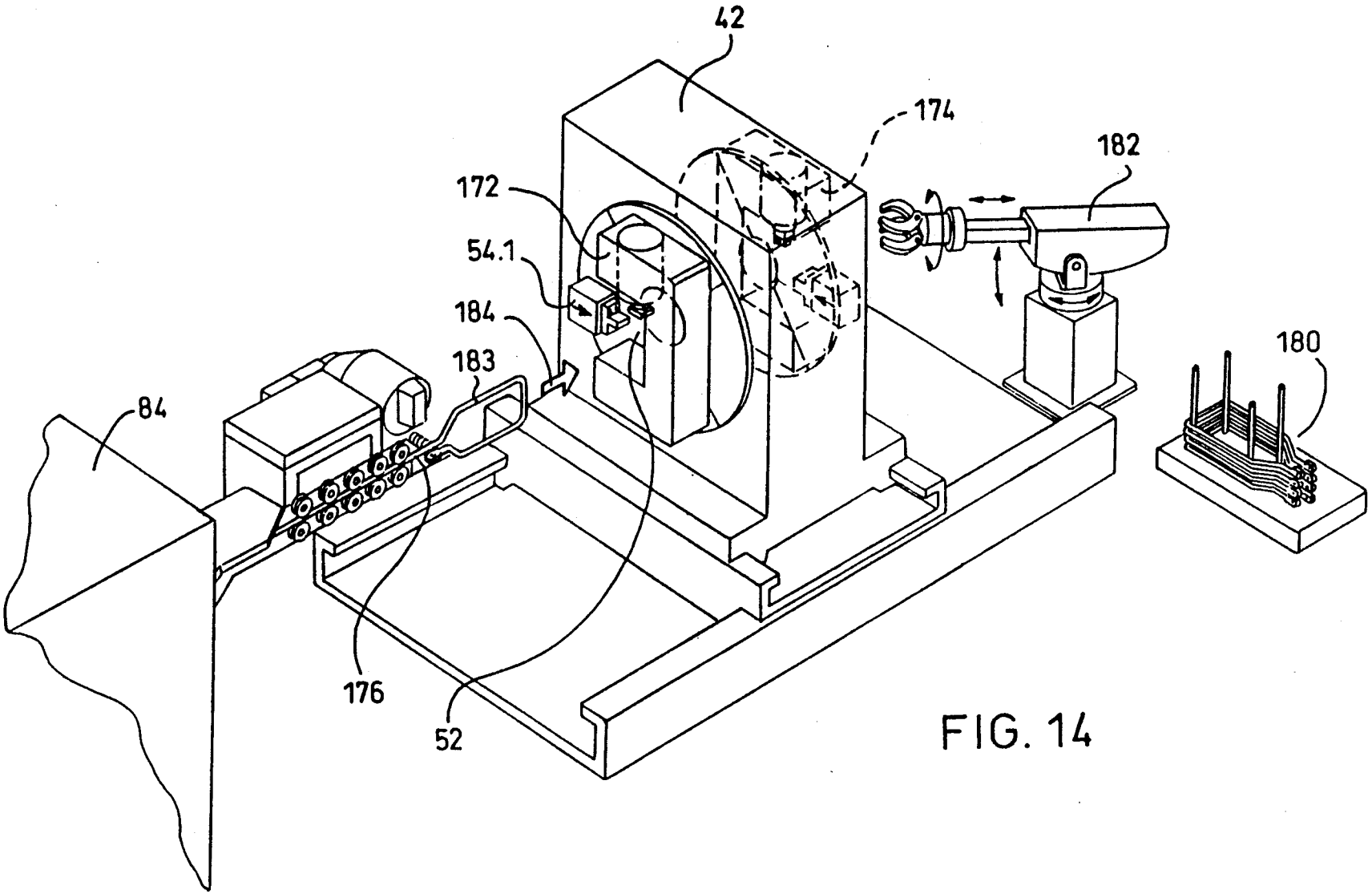
FIG. 14 is a partial perspective view of the system of FIG. 13 during a stage of manufacture of the workpiece in FIG. 12.

In FIG. 14 the wire stock 176 has been drawn back by bender 84 which, following know techniques, has been operated to make a preform 183 having bends needed for workpiece 170. Since the preform 183 is still affixed to the wire stock, the preform 183 is advanced, as suggested by arrow 184 to wire flattener 172 on platform 42. The manipulator 182 in the meantime has been moved to its workpiece receiving position as shown.

Figures 15, 16:
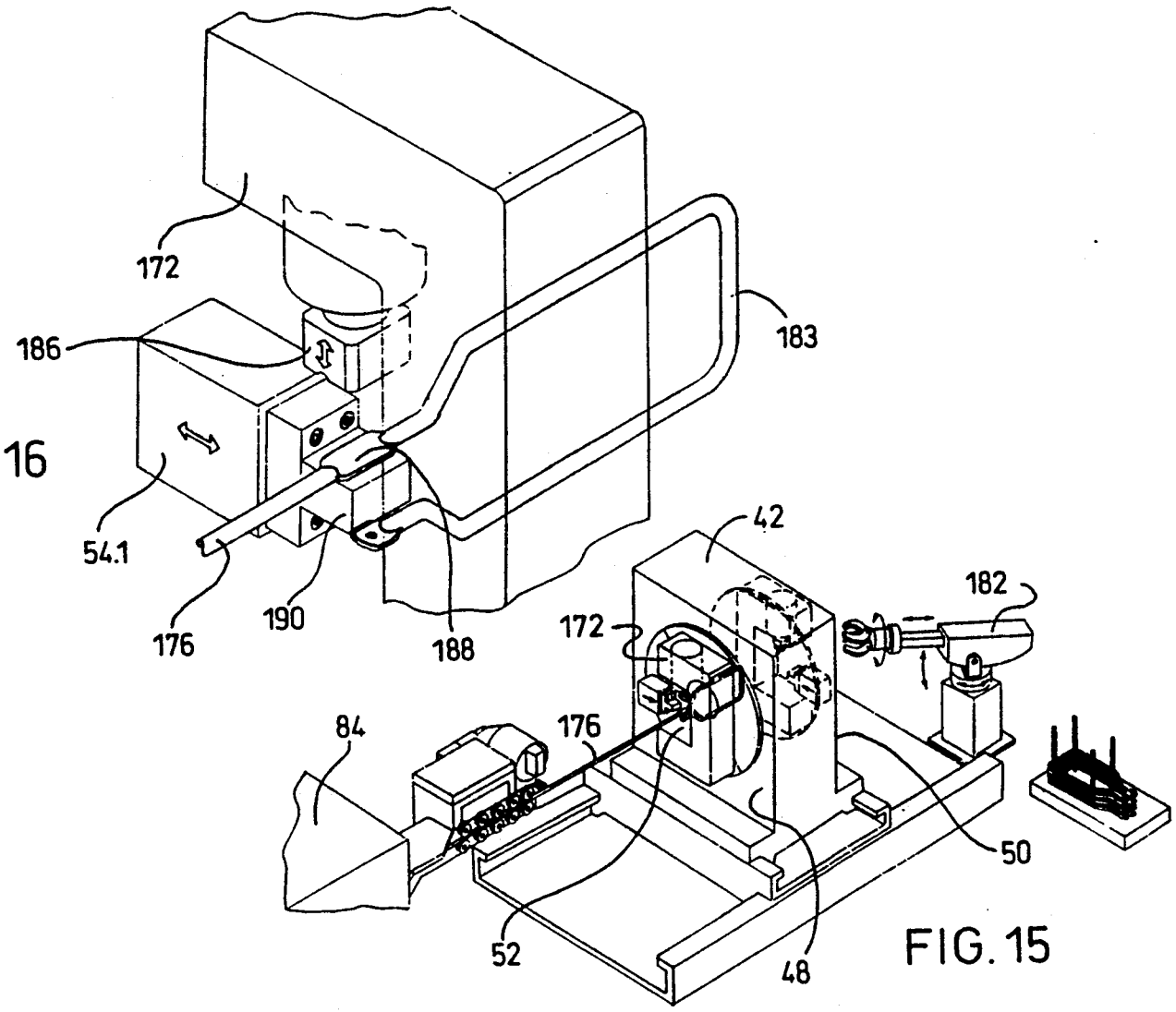
FIG. 15 is a partial perspective view of an intermediate stage in the manufacture of the workpiece in FIG. 12 with the system of FIG. 13.
FIG. 16 is an enlarged perspective view of the workpiece at its intermediate manufacturing phase as shown in FIG. 15.

In FIG. 15 and 16 the preform 183 is advanced into the workzone 52 in working relationship with flattener 172. This has a hammer 186 poised to impact on the round wire stock 176 to deform it into a flattened portion 188. Hammer 186 operates against an anvil 190 that is momentarily moved into operative position by tool actuator 54.1 below hammer 186 and below wire stock 176.

Figure 18:
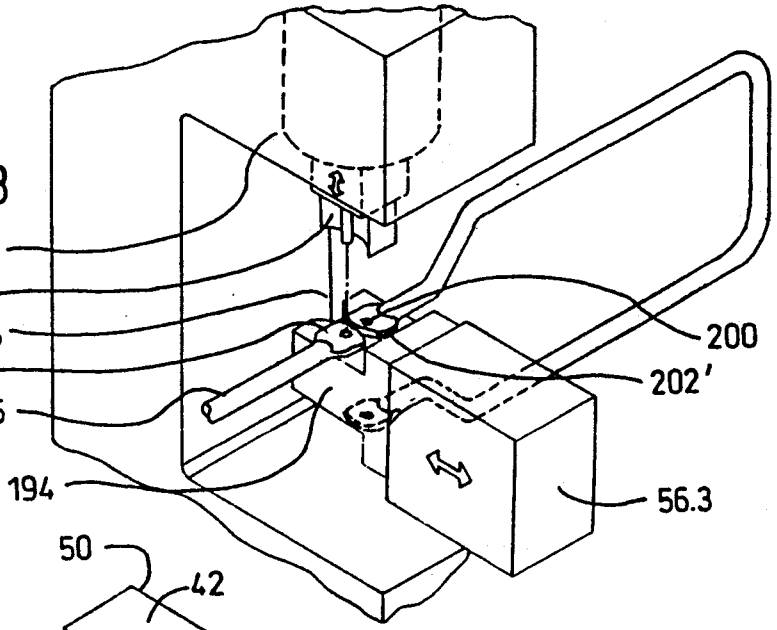
FIG. 18 is an enlarged view of the stage of manufacture of the workpiece in FIG. 17.
Figure 17:
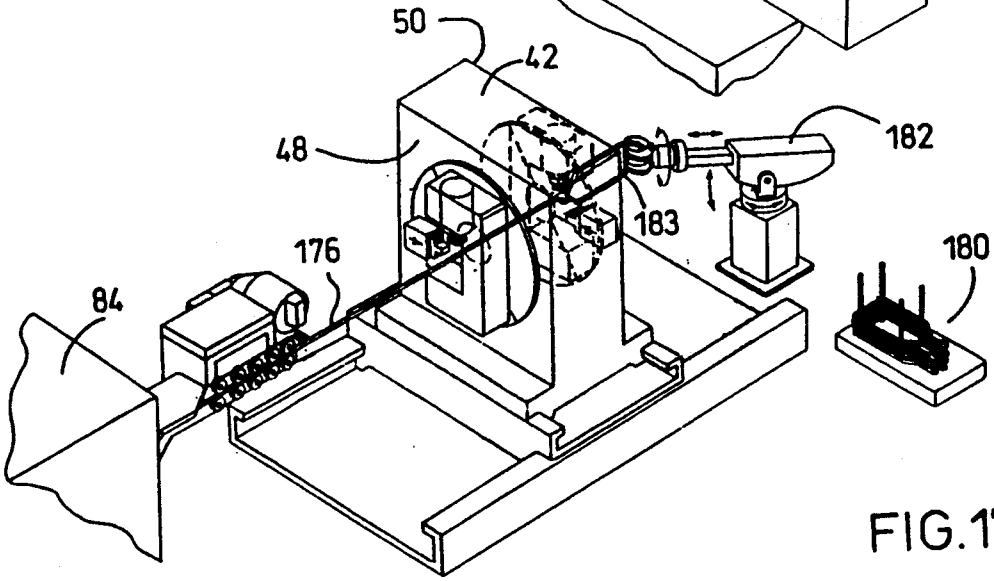
FIG. 17 is a partial perspective view of another stage in the manufacture of the workpiece of FIG. 12 with the system of FIG. 13.

As illustrated in FIGS. 17 and 18, the workpiece 183 is moved through workzone 52 to side 50 of platform 42. The previously flattened portion 188 is placed in working relationship with respect to the cutter and hole puncher 174. Tool actuator 56.3 is moved to place an apertured anvil 194 below flattened portion 188 and the manipulator 182 is positioned to grip preform 183.

The puncher 174 has an appropriate die 196 so as to cut through the middle of flattened portion 188 and shear-punch holes 198, 200 in the flattened segment 202, 202'. The workpiece 170 can now be removed by manipulator 182 and placed on stack 180. The flattened and punched segment 202 remains affixed to wire stock 176 to restart the manufacturing cycle.

Figures 19, 20, 21:
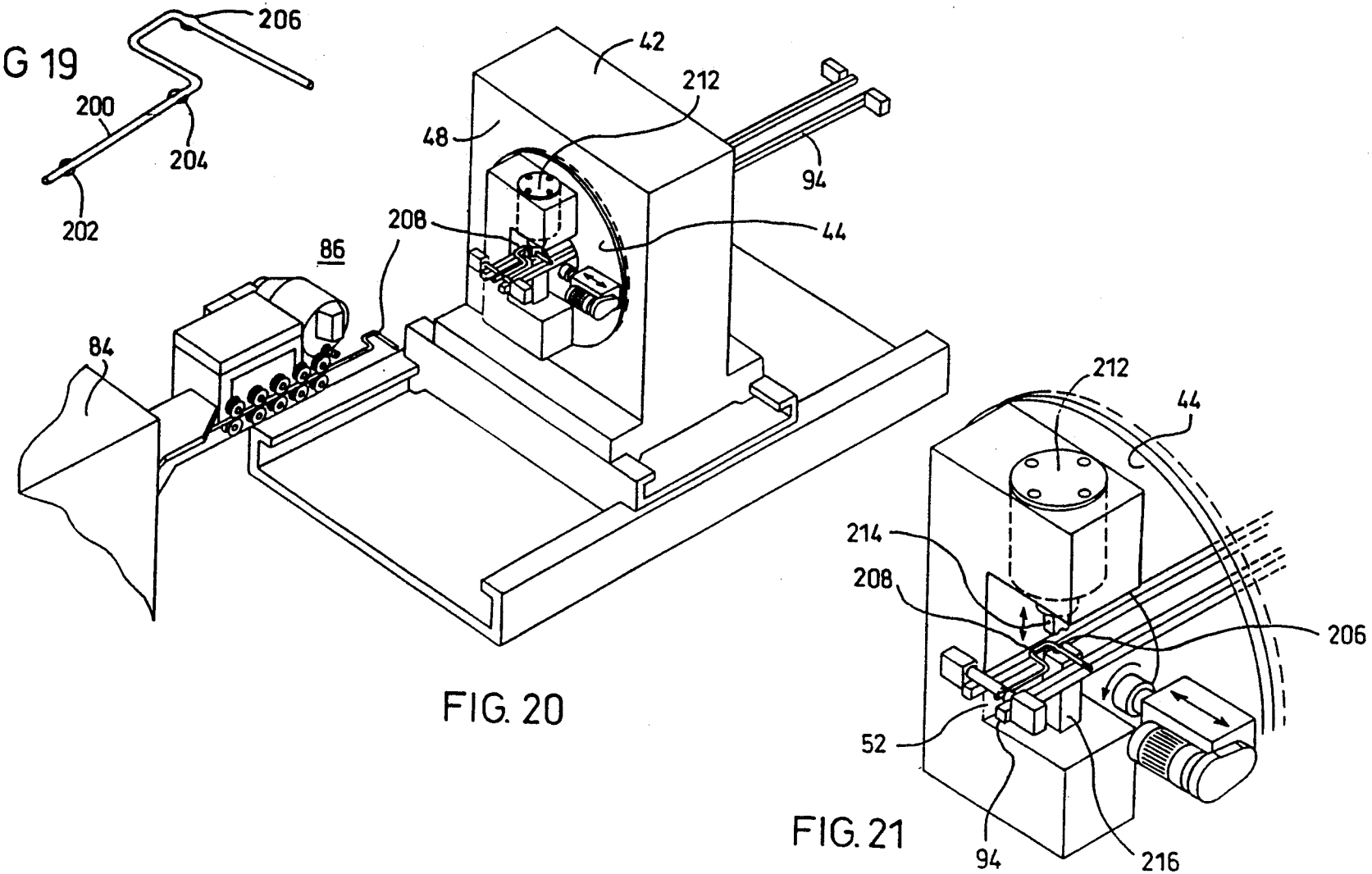
FIG. 19 is a perspective view of another workpiece made in accordance with the invention.
FIGS. 20 and 21 are partial perspective views of an intermediate manufacturing stage of the workpiece of FIG. 19.

FIGS. 19–25 illustrate the versatility and production speed of wire working system 86 when making workpiece 200 as shown in FIG. 19 with orthogonally oriented flattened segments 202, 204 and 206. The wire bender 84 produces a preform 208 having the general shape of workpiece 200 but lacking the flattened segment. A conveyor 94 is used to transfer the severed preform 208 to the working zone 52 in platform 42.

The rotatable tool mount 44 on side 48 has a flattener tool 212 oriented to form the flattened segments 206 when the preform is placed opposite flattening die 214. The die 214 is operated against an anvil 216 that is a fixed part of flattener 212.

Figure 23:
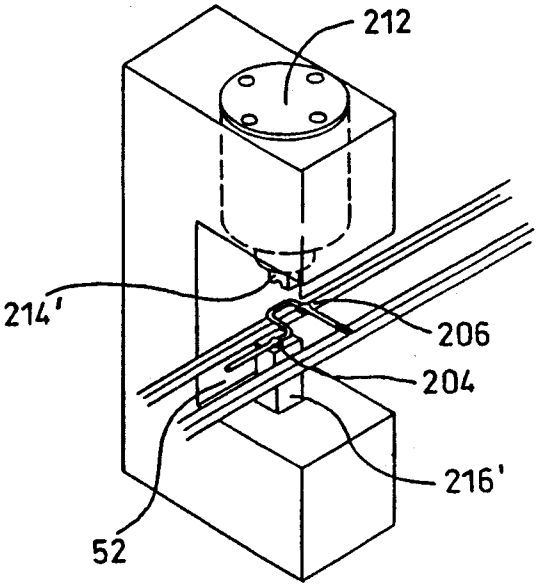
FIGS. 22 and 23 are partial perspective views of a successive stage in the manufacture of the workpiece of FIG. 19.
Figure 22:
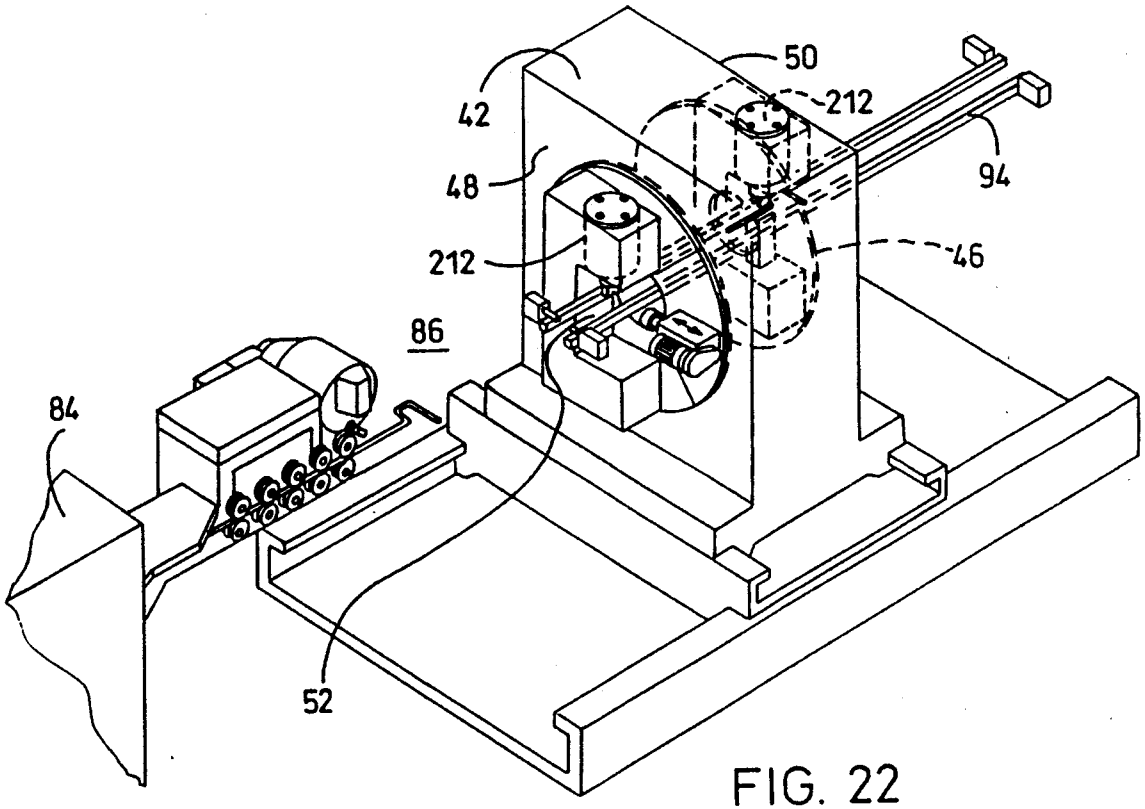
Figure 25:
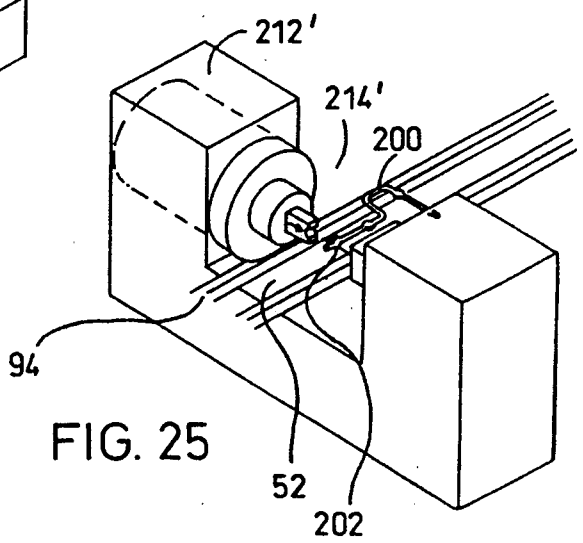
FIGS. 24 and 25 are partial perspective views of a final stage in the manufacture of the workpiece of FIG. 19.

After forming flat 206, the preform 208 is passed through the workzone 52 to platform side 50 in working relationship with a similar flattening die 214' as 214 but transversely oriented. When flattener tool 212' is actuated with the orientation as shown in FIG. 23 the flat 204 is formed.

Figure 24:
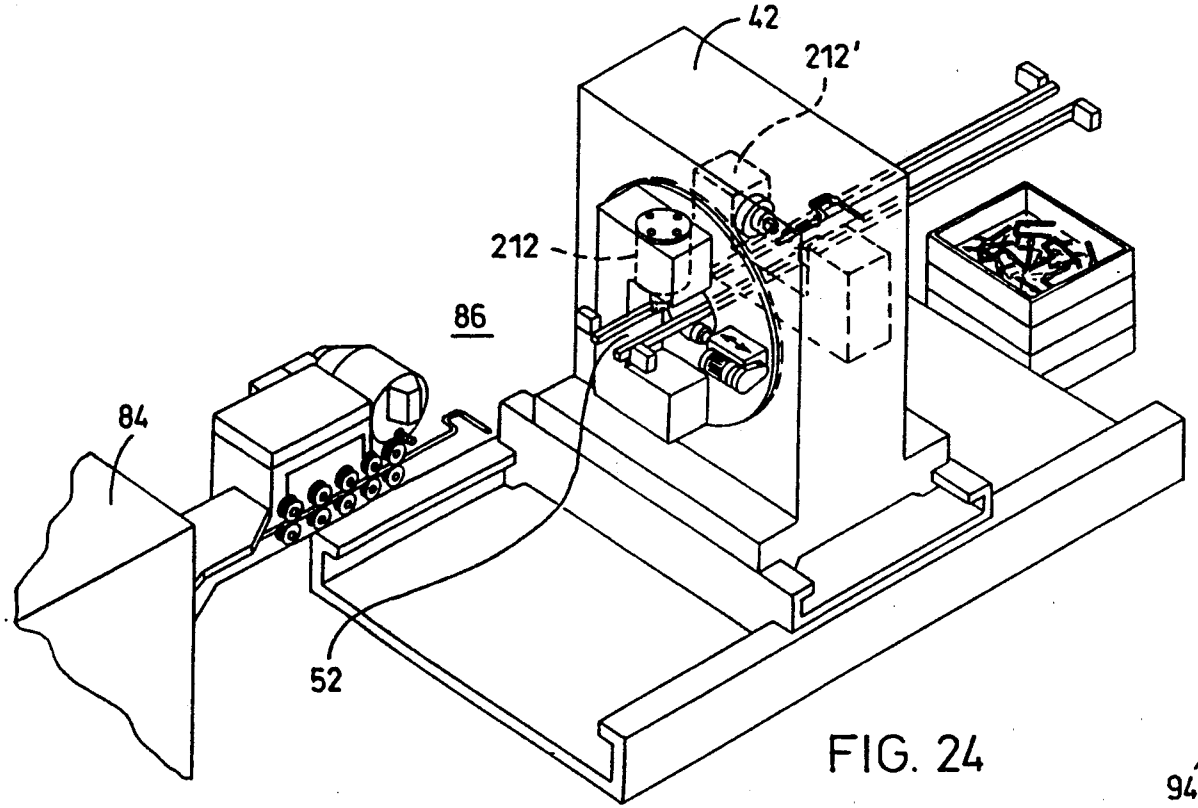

As shown in FIG. 24, tool mount 46 is then rotated 90 degrees and the preform 208 advanced by conveyor 94. In this orientation of flattener 212', the flattened segment 202 is formed to complete the manufacture of workpiece 200.

FIGS. 26–31 illustrate a technique for assembling a workpiece 220 as shown in FIG. 26 and formed of three originally separate wire parts 222, 224 and 226. At 228 in FIG. 27, the wire bender 84 forms part 222 with its bent up portion 230 while stem 232 remains affixed to wire stock 234 and at bender 84.

At 240 working platform 42 is provided with wire stock 242 from which part 224 is to be made. The stock 242 is advanced into the workzone 52 and placed across a male bending die 244. Tool actuator 54.2 is provided with a cutter 246 and a female bending die 248. When actuator 54.2 is operated, die 248 contacts and holds wire 242 before cutter 246 severs stock 242.

Another wire stock 250 to form part 226 is fed to workzone 52 into a recess 252 in die 244. Part 226 is severed from stock 250 by a shear cutter 254 located on tool actuator 54.3.

Figure 30:
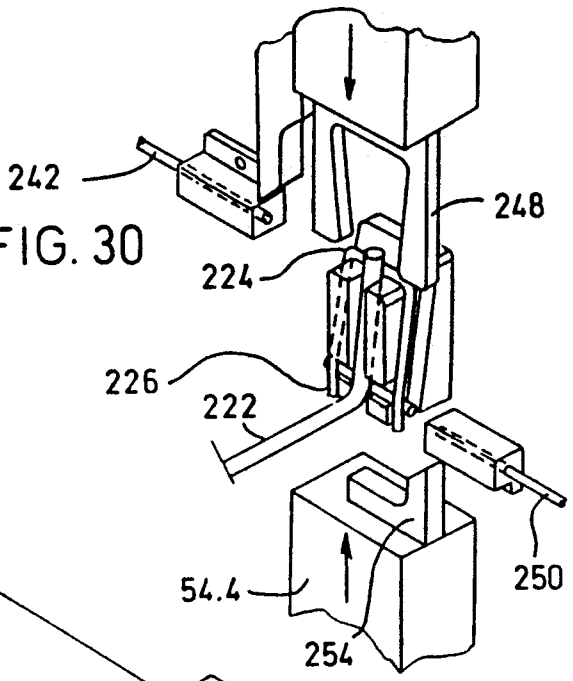
FIGS. 29 and 30 are perspective views respectively of the system and portion shown in FIGS. 27 and 28 and for an intermediate stage of manufacture.
Figure 29:
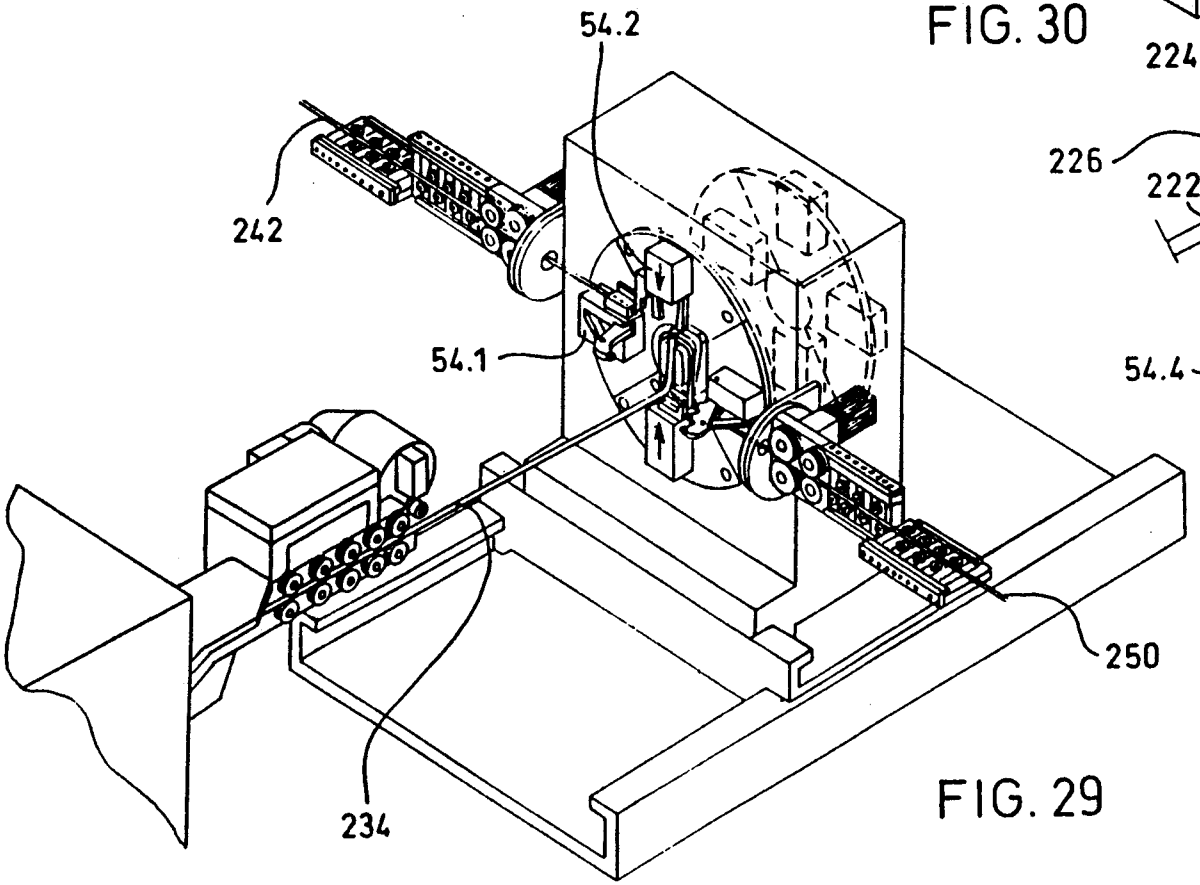
Figure 32:
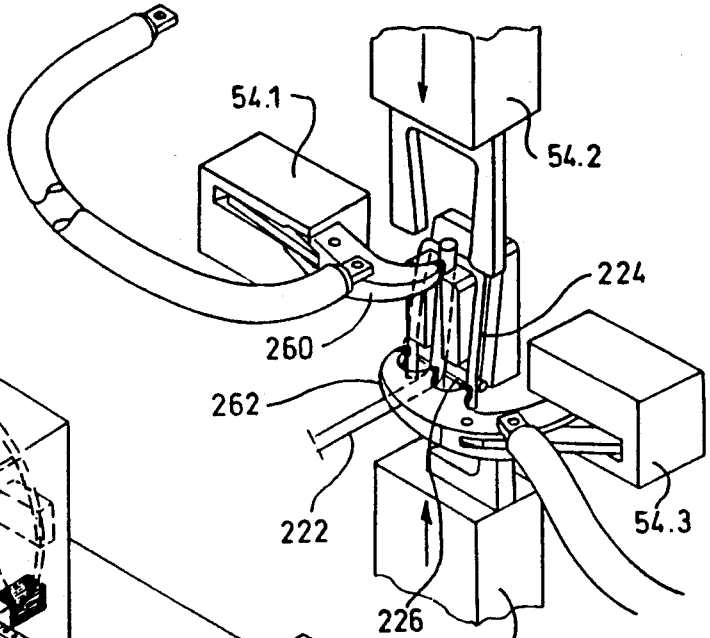
FIGS. 31 and 32 are perspective views respectively of the system and portion shown in FIGS. 27 and 28 and for the final stage of manufacture of the workpiece shown in FIG. 26.
Figure 31:
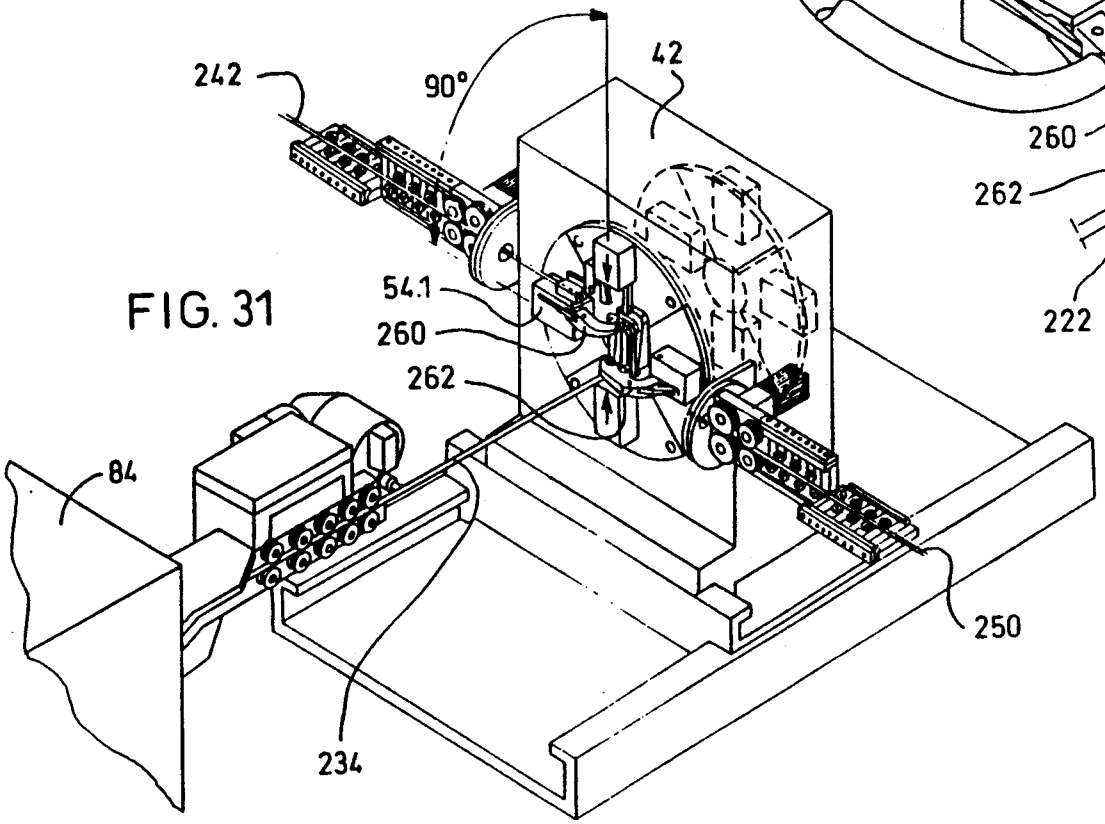

FIGS. 29 and 30 illustrate the final pre-assembly of the parts 222, 224 and 226 in the workzone 52 while being held in contact with each other. The parts are welded together as illustrated in FIGS. 31 and 32. The tool actuators 54.1 and 54.3 are provided with electrodes 260, 262 that are shaped to contact an appropriate part to form electric welds between them.

Having thus described a wire working machine and system and various applications thereof, the advantages of the invention can be appreciated. Variations can be implemented without departing from the scope of the invention.

What is claimed is:

1. A working tool for a wire working machine, comprising:

a tool holder having a first part extending therefrom at one end and having a cone-shaped tool mount at another end, said tool holder being releasably mountable with its cone-shaped end to a universal tool mount;

a wire former having a second part extending therefrom;

said first and second parts being sized and shaped to interfit in lateral and longitudinal interlocking relationship with each other so as to provide a referenced position for the wire former that is maintained throughout high force operation of the wire working machine and to restrain said wire former from lateral and longitudinal movement with respect to said tool holder, and means for releasably mounting the first and second parts to each other.

2. A working tool for a wire working machine, comprising:

a tool holder having a first part extending therefrom;

a wire former having a second part extending therefrom;

said first and second parts being sized and shaped to interfit in lateral and longitudinal interlocking relationship with each other so as to provide a referenced position for the wire former that is maintained throughout high force operation of the wire working machine, and means for releasably mounting the first and second parts to each other;

wherein one of said parts has a reference slot and a mounting surface adjacent thereto and the other of said parts has a recess sized to snugly receive the mounting surface and a reference lip sized to snugly engage the reference slot.

3. The working tool for a wire working machine as claimed in claim 2 wherein said tool holder includes a universal tool holder.

4. A working tool for a wire working machine, comprising:

a universal tool holder and a first part extending therefrom, said first part having a locking surface and a reference slot; and a wire former having a second part extending therefrom, said second part having a recess sized to snugly receive the locking surface of the first part and further having a reference lip sized to snugly fit into the reference slot; and means for connecting the first and second parts.

5. The working tool as claimed in claim 4 wherein the reference slot is located adjacent said universal holder.

6. The working tool as claimed in claim 5 wherein the locking surface has a rectangular peripheral shape and wherein the recess in said second part is correspondingly shaped.

* * * * *